US010941012B2

(12) United States Patent
Paganelli et al.

(10) Patent No.: US 10,941,012 B2
(45) Date of Patent: Mar. 9, 2021

(54) METHOD FOR MANAGING PRODUCTION AND PACKAGING LINES OF LOGS OF TISSUE PAPER AND LINE USING SAID METHOD

(71) Applicant: Fabio Perini S.p.A., Lucca (IT)

(72) Inventors: Luca Paganelli, Monte San Quirico (IT); Davide Ghiselli, Montuolo (IT); Luca Frasnetti, Montecarlo (IT)

(73) Assignee: Fabio Perini S.p.A., Lucca (IT)

( * ) Notice: Subject to any disclaimer, the term of this patent is extended or adjusted under 35 U.S.C. 154(b) by 58 days.

(21) Appl. No.: 16/336,574

(22) PCT Filed: Sep. 26, 2017

(86) PCT No.: PCT/IB2017/055835
§ 371 (c)(1),
(2) Date: Mar. 26, 2019

(87) PCT Pub. No.: WO2018/060841
PCT Pub. Date: Apr. 5, 2018

(65) Prior Publication Data

US 2019/0233236 A1 Aug. 1, 2019

(30) Foreign Application Priority Data

Sep. 27, 2016 (IT) ..... 102016000096943

(51) Int. Cl.
*B65H 26/08* (2006.01)
*B65H 26/00* (2006.01)
*B65H 18/08* (2006.01)

(52) U.S. Cl.
CPC ..... *B65H 26/00* (2013.01); *B65H 18/08* (2013.01); *B65H 2301/41702* (2013.01); *B65H 2701/1924* (2013.01)

(58) Field of Classification Search
CPC ..... B65H 26/00; B65H 18/08; B65H 2701/1924; B65H 2301/41702
See application file for complete search history.

(56) References Cited

U.S. PATENT DOCUMENTS

| | | | | |
|---|---|---|---|---|
| 4,161,094 | A | 7/1979 | Blidung et al. | |
| 4,328,931 | A | 5/1982 | Bullock, Jr. et al. | |
| 5,170,877 | A | 12/1992 | Francioni | |
| 2002/0193903 | A1* | 12/2002 | Buchholz | B65H 18/08 700/122 |
| 2005/0284277 | A1* | 12/2005 | Casella | B23D 59/001 83/488 |
| 2013/0315814 | A1* | 11/2013 | Miller | B01J 19/22 423/448 |

FOREIGN PATENT DOCUMENTS

| | | | |
|---|---|---|---|
| EP | 1127791 | A1 | 8/2001 |
| EP | 1243539 | A2 | 9/2002 |
| EP | 1609570 | A1 | 12/2005 |
| EP | 1614628 | A2 | 1/2006 |
| IT | 1314831 | B1 | 1/2003 |

* cited by examiner

*Primary Examiner* — Sang K Kim
(74) *Attorney, Agent, or Firm* — Breiner & Breiner, L.L.C.

(57) ABSTRACT

The method provides for detecting a temporary stop request by a machine of the line, for example to replace a member subject to wear or a consumable. In view of this stop, the speed of the line is modulated so as to increase, for example, the level of filling of an accumulator, and makes sure that the subsequent temporary stop has a minimum effect on the overall productivity of the line.

19 Claims, 4 Drawing Sheets

METHOD FOR MANAGING PRODUCTION AND PACKAGING LINES OF LOGS OF TISSUE PAPER AND LINE USING SAID METHOD

TECHNICAL FIELD

The present invention relates to methods for managing lines of machines arranged in sequence to carry out successive machining operations on a semi-finished material and obtain a finished product.

More in particular, a method for managing a production and packaging line of logs of tissue paper is described, in which semi-finished products or packs of finished products in rolls are obtained from parent reels of tissue paper.

BACKGROUND ART

For the production and packaging of rolls of tissue paper, for example rolls of toilet paper or kitchen towels, converting and packaging lines are used, which in a typical configuration, can comprise one or more unwinders, each of which supplies a (single or multiple) ply of tissue paper toward a rewinder. Two or more unwinders can operate in parallel to supply several plies coming from several reels. In some configurations, two or more unwinders are arranged to operate in sequence, so that while one or more unwinders supply tissue paper from one or more respective parent reels, in the other unwinder or unwinders operations to replace exhausted reels with new reels can be carried out.

Downstream of an unwinding station, where one or more unwinders are provided, the converting and packaging line normally comprises a rewinder, in which one or more plies of tissue paper are wound in logs with the same diameter as the diameter of the finished rolls intended for sale and consumption, but the axial length whereof is a multiple of the axial length of the finished products. Downstream of the rewinder there an accumulator is usually arranged, which separates a first upstream section, comprising the rewinder and the unwinder or unwinders (as well as any further auxiliary machines, such as embossers, printing machines, perforation units, ply-bonding units, etc.), from a second downstream section. Downstream or upstream of the accumulator one or more machines are usually provided, arranged in parallel, for sealing the tail end of the logs.

In the present context the terms "upstream" and "downstream" refer to the general feed direction of the material along the line. The section downstream comprises one or more machines, which process the logs coming from the rewinder.

Downstream of the machine or machines for sealing the tail end one or more cutting machines can be arranged, which cut the single logs into rolls intended for sale and consumption. The rolls are in turn fed to packaging machines. In some cases wrapping machines can be provided that group together pluralities of rolls and wrap them in a pack formed by a sheet material, for example a plastic film. Several packs can then be fed to one or more bundling machines, which bundle the packs in respective bundles or other wrappings, again made of a sheet material, for example a plastic film.

In some known layouts the downstream section can have two branches in parallel, each of which has one machine or a sequence of machines. The two branches can typically be the same, to carry out the same operations on two partial flows of logs coming from the accumulator. For example, a single machine for closing the tail end of the logs can be provided and, downstream thereof, two branches can be arranged, each of which comprises a cutting machine and one or more wrapping machines arranged in series.

In tissue paper converting and packaging lines there are various stations that require temporary stops, due to exhaustion of consumable materials (so-called consumables) and/or to wear of components that require to be periodically replaced. For example, the unwinder and consequently the rewinder must be stopped when the parent reel is exhausted and requires to be replaced, unless a high speed, on-the-fly change system is provided for changing the parent reel, said system being complex, costly and bulky and therefore not always available.

Other typical consumables of the line are plastic sheets or films for packaging. The wrapping machines must be temporarily stopped to replace the exhausted reels of plastic film, i.e. to replenish the stock of sheet material for packaging.

Further consumables consist of lubricating oils or grease.

Typical operations to replace worn components are linked to maintenance of the cutting machines, where the cutting blades must be periodically replaced due to wear caused by the paper material and by the grinding wheels on the blade. The grinding wheels must also be periodically replaced due to wear.

These temporary stops cause transients in the line that can lead to loss of production and in certain cases can have negative effects on the operation of the machines.

Italian patent no. 1314831 discloses a method for the reactive management of the flow of information between nodes representing single machines or stations of a processing line, for example a processing line of tissue paper products. The method described in said patent allows each machine to establish the optimal operating speed as a function of its own maximum speed and of the request coming from the downstream machines, as well as the availability offered by the upstream machines. Such line is capable of reacting adaptively to variations of the operating conditions The known method disclosed in the Italian patent 1314831 allows the implementation of a change to the operating conditions of the various stations or machines in reaction to transient events, such as a stop or a slowdown of one or more machines. As a consequence of this, the operating conditions of the various stations adapt in response to these transient events.

Reactive methods and production and/or packaging lines, i.e. which are capable of reacting to variations in the operating conditions, are disclosed also in EP1127791, EP1614628, U.S. Pat. Nos. 5,170,877, 4,161,094.

A need therefore exists for more efficient methods to deal with transient stops of one or more machines or stations of a tissue paper processing line for producing logs, or the like.

U.S. Pat. No. 4,328,931 discloses a production line for producing logs of tissue paper from parent reels. The line comprises means to determine whether a given section of the line, for example the rewinder or the cutting machine, is operating correctly or is idle. The production line disclosed in U.S. Pat. No. 4,328,932 also comprises decision blocks that select the speed of the rewinder based on the status or on the efficiency of the cutting machine and based on the status of the accumulator or on the number of empty spaces available in the accumulator. In particular, the rewinder is made to operate at low speed if few empty spaces are available in the accumulator, or at a higher speed if the empty spaces available are above a predetermined number. In this way, the speed of the rewinder is optimized as a function of the amount of space available in the accumulator. The production speed is modulated to avoid having to stop the rewinder if there are not enough empty spaces remaining in the accumulator.

Therefore, this known system operates with a reactive logic, i.e. in which the speed of a machine (the cutting machine) is changed as a function of a condition existing in another machine of the line (accumulator).

SUMMARY OF THE INVENTION

According to a first aspect, disclosed herein is a method for managing a production and packaging line of tissue paper products, comprising: at least one log accumulator; upstream of the log accumulator, a first line section comprising at least one unwinder and one rewinder; downstream of the log accumulator, a second line section comprising at least one processing station, for example a packaging machine. The method can comprise the following steps:

- unwinding a parent reel by means of the unwinder and feeding a ply of tissue paper toward the rewinder;
- in the rewinder, winding the ply of tissue paper and sequentially forming logs of tissue paper;
- accumulating logs produced by the rewinder in the log accumulator;
- detecting at least one temporary stop or temporary slowdown request coming from the first section, or from the second section;
- before carrying out the requested temporary stop or temporary slowdown, temporarily changing the rate of production of at least one machine of the line to minimize the impact of the subsequent temporary stop or temporary slowdown on the production rate of the line.

After having temporarily changed the rate of production of said at least one machine of the line, the requested temporary stop or temporary slowdown is carried out.

Contrary to known methods, which allow the production speeds of the various machines of the line to be adapted in a reactive manner, i.e., as a consequence of a stop or slowdown of one or more machines, the method described herein is of predictive type. In other words, the need to stop or slow down one or more machines of the line is predicted in advance and a variation in speed is imposed on at least one or more of the machines of the line, thereby enabling a reduction in the subsequent impact that the temporary stop or temporary slowdown has on the overall productivity of the line. For example, by predicting the need to replace a parent reel of the unwinder, it is possible to take action on the speeds or rates of production of one or more machines of the line before the unwinder requires to slow down or stop for replacement of the parent reel. Modulation of the speed or rate of production anticipates the event represented by the stop or slowdown of the unwinder and enables the line to be placed in optimal conditions to reduce the impact that the future temporary stop or slowdown will have on the overall productivity.

While in U.S. Pat. No. 4,328,931, for example, the rewinder is slowed down if the empty spaces in the accumulator decrease, or vice versa, the method of the present invention provides for:

- predicting a future condition that has not yet occurred, which will, for example, influence the capacity of a section of the line to absorb product,
- and based on this prediction, before the event occurs, changing the operation of a machine or section in order to reduce the impact that the future stop will have on the overall operation of the line.

For example, it is possible to predict the need to stop an unwinder because the reel of web material to be supplied to the rewinder is approaching exhaustion. To prevent this stop from having a negative impact on the operation of the downstream sections of the line, before the event (unwinder stop) occurs, the speed of operation of the downstream sections is modulated to increase the stock of material (logs) traveling along the converting line, for example by filling an accumulator. In this way, once the event (unwinder stop) occurs, this will have no negative effects, for example, on the wrapping machine. The stock in the accumulator can be increased by temporarily decreasing the speed of the cutting machine, or by temporarily increasing the speed of the rewinder.

Therefore, the method described herein is based on an approach which is different from that of reactive systems, such as the one disclosed in U.S. Pat. No. 4,328,931. In fact, these latter are based on the detection of an event already in progress (small number of empty spaces in the accumulator) and influence the operation of the upstream machines accordingly (slowdown of the rewinder). The method disclosed herein anticipates the event, predicting in advance the future need for a stop, for example, and temporarily changes one or more production parameters to place the line in the optimal condition to deal with the future (not yet current, that has not yet occurred) event.

Further explanatory examples will be illustrated in greater detail below.

It would also be possible for a reactive adaptation of the line to take place during the period of temporary stop or slowdown, according to known methods, this reactive adaptation being added, as positive effect on the production speed, to the predictive effect described above.

According to some embodiments, the step of temporarily changing the rate of production of at least one machine of the line comprises the step of changing the level of filling of the log accumulator, as a consequence of the variation of the rate of production of said at least one machine.

According to a particularly advantageous embodiment, the step of temporarily changing the rate of production of at least one machine of the line comprises the step of changing the level of filling of the log accumulator so as to:

- temporarily increase an amount of logs present in the log accumulator, if the temporary stop or temporary slowdown request comes from the first section;
- or temporarily reduce the amount of logs present in the log accumulator if the temporary stop or temporary slowdown request comes from the second section;

The requested temporary stop or temporary slowdown is carried out after having changed the level of filling of the log accumulator.

In some embodiments, the step of temporarily changing the rate of production of said at least one machine of the line can comprise:

the step of slowing down at least one machine of the second section, if the temporary stop or temporary slowdown request comes from the first section, so as to increase the amount of logs accumulated in the log accumulator before the temporary stop or the temporary slowdown;

the step of accelerating at least one machine of the second section, if the temporary stop or temporary slowdown request comes from the second section, so as to reduce the amount of logs accumulated in the log accumulator before the temporary stop or the temporary slowdown.

If the temporary stop or temporary slowdown request comes from the first section, it would also be possible for the step of temporarily changing the rate of production of said at least one machine of the line to comprise the step of accelerating at least one machine of the first section, for example the rewinder (and consequently the machines that serve it, for example unwinder, embosser, etc.), so as to increase the amount of logs accumulated in the log accumulator before the temporary stop or the temporary slowdown. Temporary acceleration of the machine or machines of the first section in order to increase the level of the log accumulator is possible in particular if, in the conditions preceding the temporary stop or slowdown request, the rewinder operates at a lower speed than the maximum permissible speed.

As will be described in greater detail below, the temporary stop or temporary slowdown request is caused by the need to replace or replenish a material subject to wear or consumption. In general, this request can be generated by any predictable event.

Advantageous further features and embodiments of the invention are described hereunder and in the appended claims, which form an integral part of the present description.

According to a further aspect, the invention relates to a production and packaging line of tissue paper products, comprising: at least one log accumulator; upstream of the log accumulator, a first section comprising at least one unwinder and one rewinder; downstream of the log accumulator, a second section comprising at least one processing station; a control system configured and arranged to implement a method as defined above.

The line can comprise a branched structure and/or structure with portions having several branches in parallel. For example, the second line portion can have two or more branches in parallel, which are fed by logs coming from the accumulator. Each branch can comprise the same number of stations or machines, or a different number of stations or machines. The machines in the two or more branches can have the same function and structure or can have the same function but different structures. For example, there can be provided different cutting machines in the various branches, or different packaging machines for the various branches. Moreover, the first section can comprise an embosser, a printing machine, a perforator, a ply-bonding device, or combinations thereof.

In the second section or, preferably, in the first section a machine can be provided for sealing the tail end of the logs coming from the rewinder. The machine for sealing the tail end can be a gluing machine, or a mechanical sealing machine, or a combined machine, which seals the tail end according to different techniques, alternatively selected by the user.

In some embodiments, the line can comprise one or more core winders, i.e., machines that produce cores made of cardboard or other suitable material, around which the web material is wound in the rewinder. The core winders can advantageously have their own accumulators, in which tubular winding cores are stored, to make the rate of production of the core winder independent from the rate of production of the remaining stations of the line.

The line can comprise one or more packaging machines, for packaging logs or rolls in suitable groups wrapped in packaging film. The packaging machines can be arranged in series, to produce packs of rolls, each containing a group of rolls, and wraps or bags containing a plurality of packs. In general, the packaging machines can have a stock, for example and preferably in the form of reels, of packaging film, which represents a consumable.

The first section comprises one or more unwinders, which have the function of unwinding a parent reel individually or several parent reels in parallel, to feed one or more plies of tissue paper toward the rewinder. The parent reels represent consumables.

One of the predictive functions of the method described is dedicated to predicting the step of replacement of a reel of material (parent reel, reel of film, etc.) with a new reel. To this end, the line can comprise, for one or more stations in which reels of consumable are provided, a detection system for detecting the amount of material available and thus for predicting the need for temporary stop or temporary slowdown to replace an exhausted reel. Regardless of the type of reel and therefore of wound material, the detection system can be interfaced with a control unit, for example a PLC or other electronic programmable unit. The detection system can comprise a transducer adapted to detect the amount of web material supplied. When the amount of web present on a reel is known, by detecting the amount supplied it is possible to predict the need for replacement. More simply, the detection system can comprise a detection device for detecting the amount of material present on the reel. For example, a system can be provided that detects the weight of the reel, by means of load cells or other detection elements. In other embodiments, a system can be provided that detects the diameter of the reel, for instance by means of an optical or capacitive system, or by means of a position transducer that detects the position of a member in contact with the cylindrical surface of the reel, or any other detection system.

In stations containing devices, members or components subject to wear, devices for the detection of wear can be provided. In some embodiments the line can comprise one or more cutting machines equipped with one or more cutting blades. Wear detectors can be associated therewith, for example as a function of the diameter of the cutting blade.

In other embodiments, consumables or devices and members subject to wear can be associated with devices for detecting the operating time.

Further features and embodiments of the method and of the line are described hereunder and in the appended claims, which form an integral part of the present description.

BRIEF DESCRIPTION OF THE DRAWINGS

The invention will be better understood by following the description and accompanying drawing, which shows practical embodiments. More specifically, in the drawing.

DETAILED DESCRIPTION OF EMBODIMENTS

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

Figure 1:
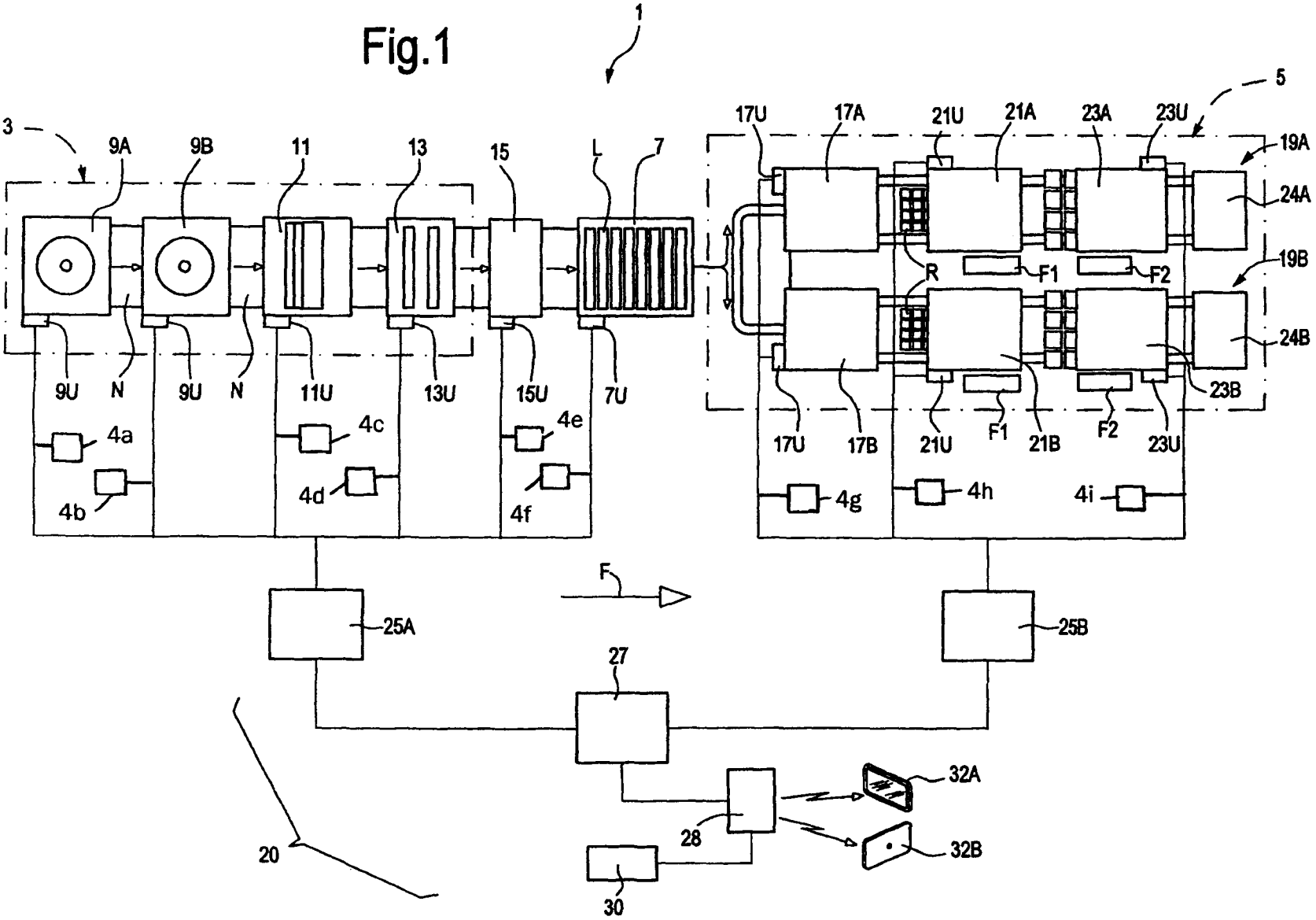
FIG. 1 shows a diagram of a line for producing packs of rolls of tissue paper.

FIG. 1 schematically represents a production and packaging line indicated as a whole with 1. The line 1 comprises a first section 3 and a second section 5. The two sections 3 and 5 are arranged in series, the first one upstream of the second one downstream with respect to an overall feed direction F of the product being processed. Between the first section 3 and the second section 5 an accumulator 7 is arranged.

Figure 1B:
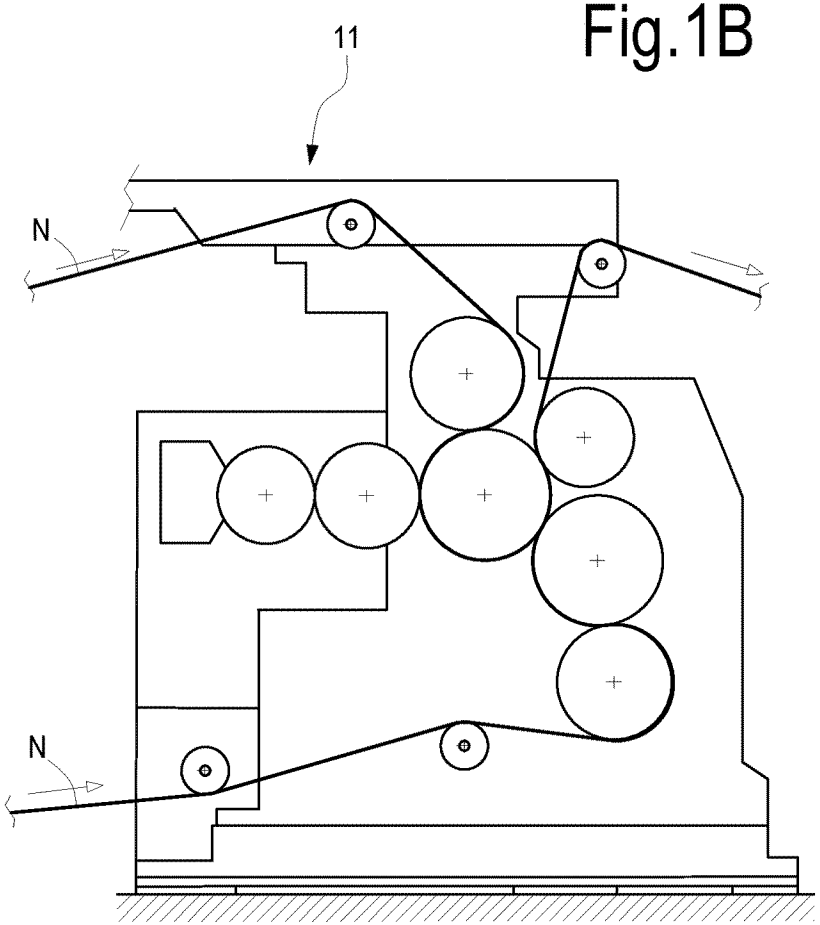
FIGS. 1A, 1B, 1C, 1D, 1E show details of single machines of the production line.
Figure 1A:
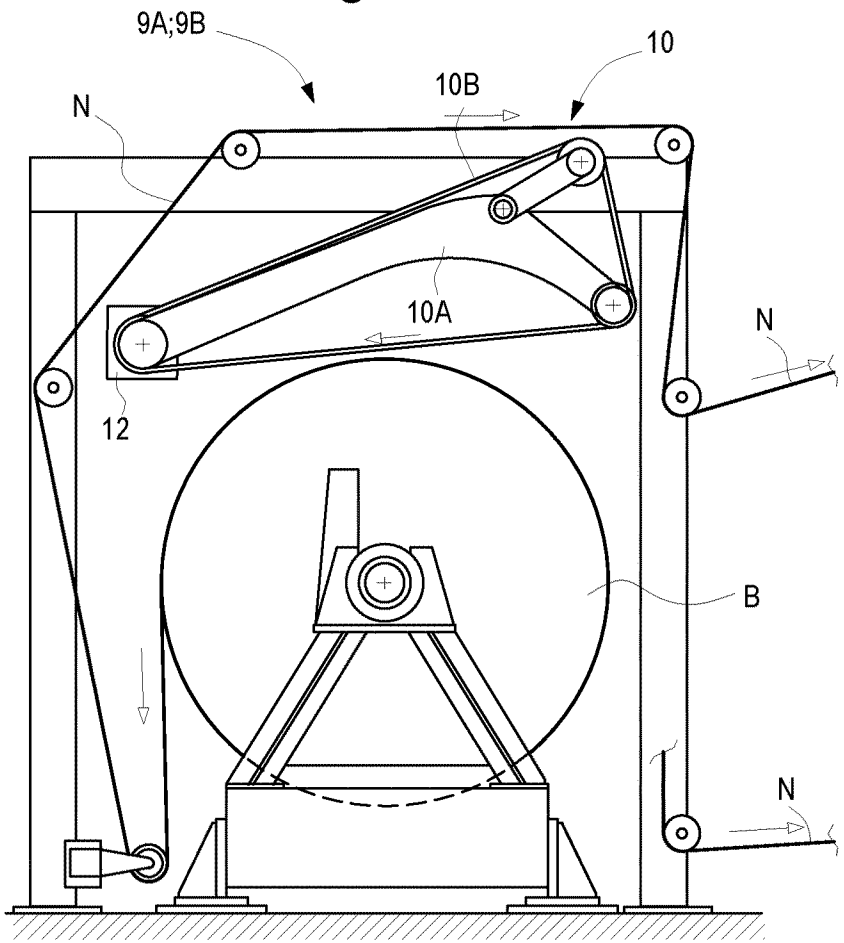

In some embodiments the first section 3 can comprise an unwinder. In the example illustrated, the first section 3 comprises two unwinders 9A, 9B, that can operate together, or and preferably alternatively, so that while one is operating the other is standing by and vice versa. Each unwinder can be configured in a manner known per se and does not require to be described in detail. FIG. 1A shows a diagram of a possible unwinder 9A, 9B, in which a parent reel B is arranged, from which a web material N is unwound by means of an unwinder member 10. Typically, the web material N is a single- or multi-ply web of tissue paper.

Figure 1D:
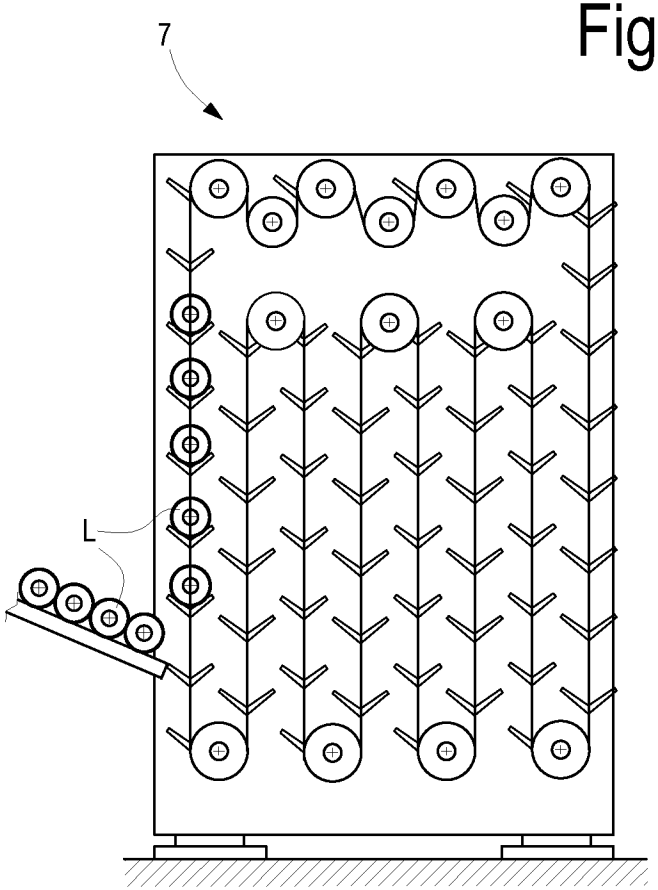
Figure 1C:
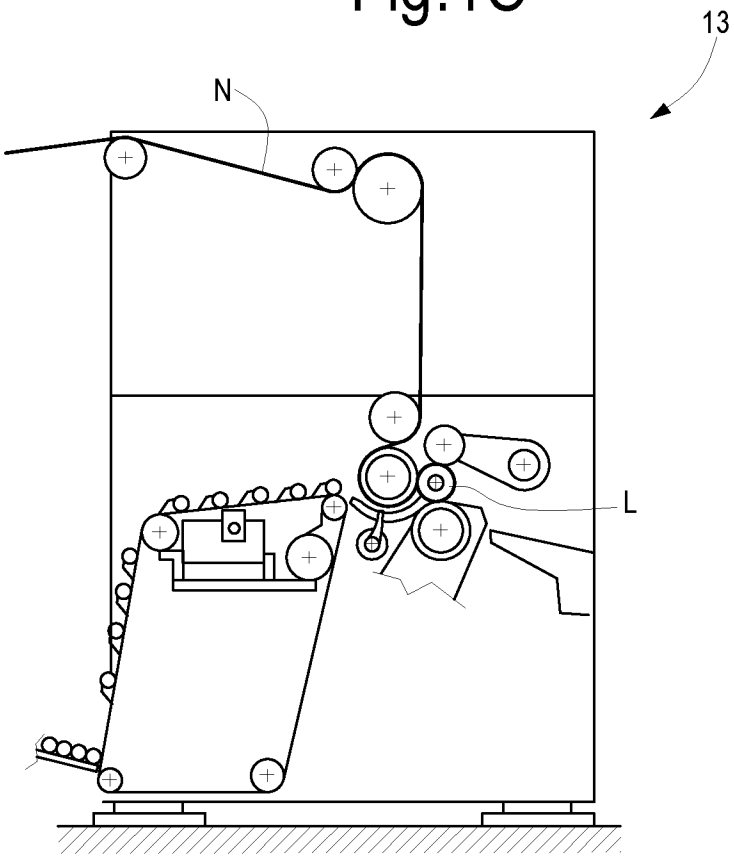

Downstream of the unwinders 9A, 9B, with respect to the feed direction of the web material N, the first section 3 can comprise an embosser, indicated schematically with 11. FIG. 1B shows a diagram of an embosser. The structure of the embosser can be of any type and is known per se. Moreover, the first section 3 can comprise a rewinder 13, positioned downstream of the embosser 11 (if present), which can be configured in a manner known per se. FIG. 1C shows a diagram of a rewinder 13. The rewinder 13 winds the web material N coming from one or more unwinders 9A, 9B in logs L, which are accumulated in the accumulator 7, which separates the first upstream section 3 from the second downstream section 5. FIG. 1D schematically shows an accumulator 7.

In addition to the machines indicated above, the first section 3 can also comprise other units, such as a perforator, a ply-bonding unit, a printing machine, etc.

Upstream or downstream of the accumulator 7 a machine 15 for sealing the tail end of the logs L can be arranged. In the exemplary diagram of FIG. 1, the machine 15 for sealing the tail end is preferably positioned upstream of the accumulator, so that the logs are accumulated in the accumulator once their tail end has been sealed, for example by gluing. Also this machine can also be configured in a manner known per se and is not described in detail.

Figure 1E:
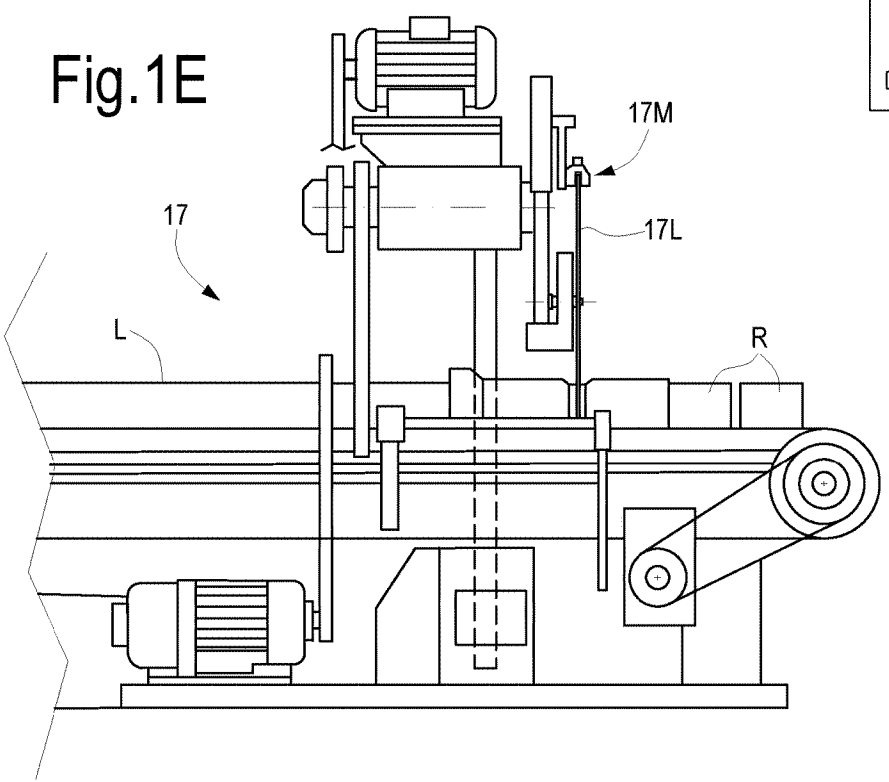

The logs L must be cut into rolls of smaller axial length. In the embodiment illustrated in the diagram of FIG. 1 to this end two cutting machines 17A, 17B are provided, positioned in two parallel branches or paths 19A, 19B. The two cutting machines 17A, 17B can be the same as or different from each other, and in general perform the same type of operation on the logs L coming from the accumulator 7, i.e., they divide the logs L into rolls of sizes suitable for packaging and sale, and they also remove the initial and tail trims of the logs. The trims can be removed by trim removers, not shown. FIG. 1E schematically shows a cutting machine 17, wherein the log cutting blade is indicated with 17L. The cutting machines 17 can be configured in a manner known per se.

The rolls R are then fed to two packing machines 21A, 21B positioned in parallel in the two branches 19A, 19B. The packs formed by ordered groups of rolls are in turn grouped and introduced into packs of larger size in respective bundling machines 23A, 23B. The packs are formed with a respective sheet material, such as a plastic film.

Downstream of the bundling machines 23A, 23B palletizers 24A, 24B can be provided. If necessary, these can be equipped with reels of plastic film or other consumable, for example banding straps, with which the pallet are made stable.

Each machine of the line 1 can be equipped with its own electronic programmable control unit, such as a PLC or a micro-computer. Each electronic programmable control unit is indicated schematically in FIG. 1 and labeled by the same reference number as the corresponding machine, followed by the letter U.

The single programmable control units can be interfaced with a central processor. In other embodiments, as indicated schematically in FIG. 1, the machines of the section 3 and the accumulator 7 can be interfaced with a processor 25A, while the machines of the section 5 can be interfaced with a processor 25B. The two processors 25A, 25B can in turn be interfaced with a monitoring processor 27.

Each programmable control unit and/or the processors 25A, 25B, 27 can be configured to manage the respective machine according to the logic disclosed in the aforesaid Italian patent no. 1314831.

The architecture of the electronic control system of the production line 1 can differ from the one represented schematically in FIG. 1. For example, a single processor could be provided, connected directly to the various members of each machine of the line. Alternatively, single PLCs, microprocessors or other local control units could be provided, one for each machine of the production line 1, connected directly to a single processor 27, without the need for intermediate control units 25A, 25B. The control logics described below can be implemented using programs that can be executed without distinction either centrally or through distributed intelligence (local PLCs). The choice of the specific architecture of the control system can be dictated, for example, by the need to interface machines or portions of line supplied by different manufacturers. An integrated system, with a smaller number of controllers or control units, can be used more easily when the whole production line 1 is supplied by the same manufacturer.

In FIG. 1 the reference numeral 20 indicates as a whole the electronic programmable control system of the line 1, said system in this embodiment comprising the local control units 9U . . . 23U (local PLCs), the processors 25A, 25B, 27 and other components that will be described below.

In summary, each machine of the line 1 is managed according to an algorithm that calculates the optimal speed of the same machine. This algorithm for calculating the optimal speeds is based on a logic model according to which the various machines of the line are represented as conversion nodes and the accumulator 7 and the conveyor belts (not shown) are represented as accumulation or storage nodes of semi-finished products. The nodes are interconnected with one another.

Each machine node is represented, regardless of the type (rewinder, cutting machine, packing machine, bundling machine, . . . ), by means of two parameters of minimum speed (Velmin) and maximum speed (Velmax) within which the machine can run. There is also provided a parameter that represents the target speed (Veltarget), i.e., the parameter representing the operating speed that the system must calculate to obtain optimal operation of the line. Each storage node (accumulator or belt) is instead represented by some parameters relating to accumulation levels of the semi-finished product useful for smooth operation of the production process: typically there will be one or two minimum accumulation levels (Livellomin) and one or two maximum accumulation levels (Livellomax) to which an actual accumulation level (Livelloact) is compared.

In addition to the aforesaid parameters, each machine, and therefore each node, can take an operating condition (RUN) or a stop condition (STOP).

To be able to calculate the optimal parameter Veltarget for all the machines that make up the line 1 there is provided a logic of comparing the flow of product that a machine should supply to the machines downstream (requested flow REQ) with the flows of product effectively available (available flow ACK) from the machines upstream. For example, each cutting machine 17A, 17B receives a request for N logs from downstream packaging machines, and has an available flow of M logs from the upstream machine 15 for sealing the tail end.

In practice, each machine receives from the downstream node a product flow request ReqO. This request, if necessary reduced as a function of the maximum product flow (Velmax) that the machine can supply, is transferred (ReqI) to the node upstream, which will in turn repeat this logic in relation to the node upstream. In this way, starting from the leaf nodes at the end of the tree (typically the bundling machines 23A, 23B) the root node (the rewinder 13) will be reached with a product flow request that will have undergone, along the path, possible reductions due to the limits of speed of the machine nodes passed through and possible re-modulations due to passing through the storage nodes calculated based on comparison of the accumulation level in relation to appropriate reference levels set.

Each machine receives from the node upstream an availability of product flow AckI. This availability is propagated to the node downstream (AckO), if necessary reduced based on the maximum product flow (Velmax) that the machine can supply. This availability of flow is propagated from the root machine (rewinder 13) to the leaf machines (typically the bundling machines 23A, 23B). At each passage each node will impose any necessary limits due to its maximum supply capacity (for the machines) or re-modulations based on the accumulation levels (for the accumulator 7 and the conveyor belts, not shown).

Figure 2:
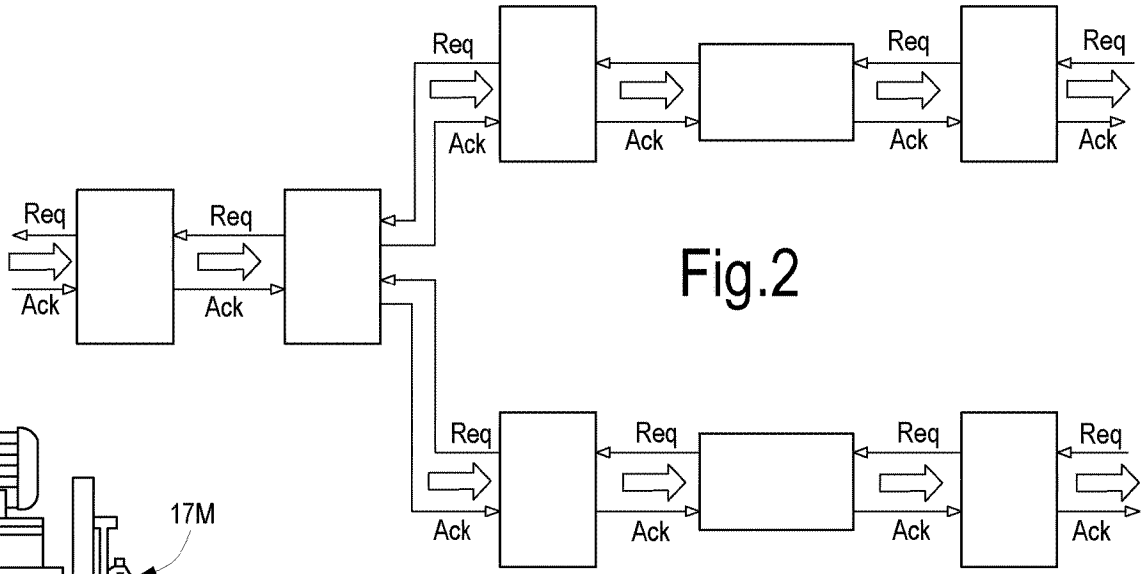
FIG. 2 shows a functional diagram illustrating the communication logic between nodes representing machines of the production line.

Propagation of the aforesaid information between generic nodes Ni is represented schematically in the functional diagram of FIG. 2, where the nodes are indicated with N1, N2, . . . and each of them can represent a generic machine of the line.

Once a machine knows the flow requests and the availabilities compatible with the limits of all the machines it can autonomously decide its run speed, i.e., the target speed $VEL_{TARGET}$.

The logic for determining the parameter $VEL_{TARGET}$ is the following:

- if from the $i^{th}$ node a given product flow ReqI is requested from the machines upstream, where this requested flow is a function of the limits of the machine represented by $i^{th}$ node and of the requests received from the nodes downstream,
- and if the total of the machines upstream confirms that against the request of the $i^{th}$ node an availability of product flow AckI can be guaranteed, then the $i^{th}$ node will take as optimal speed or target speed $VEL_{TARGET}$ the lower between the values AckI and ReqI:

$$VEL_{TARGET}=\min(ReqI,AckI)$$

The logic of the system described above is very reactive and reacts well and naturally to any change of flow capacity of the various machines due to a whole variety of reasons which can, for example, be:

- machine stopped for functional reasons:
  - change of parent reel in the unwinder 9, 9A, 9B, change of cutting blade 17L in the cutting machine 17, 17A, 17B, change of reel of packaging film in the packaging machines 21A, 21B, 23A, 23B, etc.
- machine stopped due to running problems:
  - fault
  - unscheduled maintenance
  - maximum speed reduced by the operator to satisfy product quality requirements.
- change of product parameters (change of production capacity)
  - e.g.: if the length of web material N wound in each log L increases significantly, the flow capacity of the rewinder 13 defined in logs/min decreases drastically;
  - e.g.: if the format of the pack produced by one of the packaging machines 21A, 21B, 23A, 23B changes, the request for logs by this machine to the cutting machine 17A, 17B upstream also varies significantly.

In any condition, by means of the logic described above, the speeds of the various in-line machines are automatically adapted to obtain the maximum productivity.

However, among these conditions, there are some events that cause a transient in the operation of one or more machines, for example a temporary stop of one or more machines, which events can be predicted in advance. These events can be treated more effectively by exploiting the accumulation capacity of logs L supplied by the accumulator 7. This can lead to an increase in productivity in some cases and, at any rate, to improved management of product flows in other cases, maintaining the speed of some machines lower (less wear, improved product) based on the prior knowledge of stop events of other machines.

In general, events that are foreseeable or predictable can relate to the exhaustion of a consumable in the production line 1. In this context, consumable also means one of the semi-finished products in the production line 1, for example the web material N of a parent reel B. By way of example, consumables can also comprise the plastic film or other packaging material used by the packaging machines 21A, 21B, 23A, 23B. Foreseeable or predictable events can also relate to the need to replace a component subject to wear. Typically subject to wear are the cutting knives or cutting blades 17L of the cutting machines 17A, 17B, 17, or the grinding wheels of these machines, the knives for cutting the plastic film of the packaging machines, the welding members of the packaging machines, and in general components subject to wear of the various machines of the line.

According to the current art, when one of these events occurs the machine is stopped and consequently the line, or the branch of the line in which the event occurs, stops. To a certain extent, the presence of the accumulator 7 can release the event that causes stopping of the single machine from the operation of the line as a whole. For example, if a cutting machine 17 is temporarily stopped to replace the cutting blade 17L, the branch 19A or 19B in which the cutting machine is located stops, while the other branch continues to operate. The rewinder 13 maintains its production speed and the logs L in excess produced by the rewinder 13 are temporarily stored by the accumulator 7. However, when this reaches a level of maximum filling, the rewinder 13 must be stopped. To reduce the need to stop the rewinder, the rate of production of the branch that remains active can be increased. However, this is not always sufficient to prevent the rewinder from being stopped. To avoid this need, the speed of the rewinder 13 can be reduced. In all these cases operation is not optimal, as the productivity of the line is reduced. The action on the operating speed of the rewinder 13 can have negative effects on the smoothness of the operation of this machine and therefore on the quality of the product. Any stopping thereof causes a considerable loss of production and the generation of waste product, both factors that adversely affect the profitability of the line.

To reduce these drawbacks, according to the method described herein measures are adopted to predict the aforesaid events and, consequently, to adopt measures that reduce or eliminate the aforesaid problems.

In general terms, the production line 1 can comprise members for predicting an event that can generate a stop request of a machine or of a portion of the line. In some embodiments it is possible to use a system that predicts only one type of predictable event, such as the need to replace a cutting blade 17L. In other embodiments it is possible to adopt means to predict a plurality of predictable events. Hereinafter, purely by way of example, it is assumed that the production line 1 is equipped as follows.

With each unwinder 9A, 9B a system can be associated, for predicting the exhaustion of a parent reel B in one or another of the various unwinders 9A, 9B of the first section 3. This system can comprise a transducer that detects the diameter of the parent reel B. In FIG. 1A to this end an angular position transducer 12 is provided, which detects the angular position of an arm 10A that supports a flexible member 10B of the unwinder member 10. It must be understood that in actual fact more sophisticated and accurate detection systems of the diameter of the parent reel B can be adopted, such as a system for directly detecting the diameter of the parent reel B, of optical, capacitive, ultrasonic or of another type. In other embodiments the web material N can be provided with an index applied in a point at a given distance from the end of the reel. A detecting system can identify the index applied and report that the parent reel is approaching exhaustion. It would also be possible to detect that the parent reel is approaching exhaustion based on knowing the overall length of the web material N contained in the parent reel B and measuring the amount of web material N supplied, for example by means of an angular transducer associated with one of the rollers around which the web material N is guided.

With each cutting machine 17A, 17B a system can be associated, for detecting the degree of wear of the cutting blade 17L of each cutting machine 17A, 17B. This detection system can use a member detecting the effective diameter of the blade 17L. Other embodiments can provide for detecting, for example by means of a transducer or encoder, the position of the grinding wheels schematically indicated with 17M in FIG. 1E with respect to the rotation axis of the cutting blade 17L.

With each of the packaging machines, i.e. the packing machines 21A, 21B and the bundling machines 23A, 23B, a detection system can be associated for detecting the amount of available packaging sheet material, typically plastic film. The stock of packaging sheet material can consist of a reel of film. FIG. 1 schematically indicates reels F1 of plastic film (or other sheet material) for the packing machines 21A, 21B, and reels F2 of plastic film (or other sheet material) for the bundling machines 23A, 23B. A detection system of the amount of film available can be associated with each machine. Systems of the same type mentioned above can be used for detecting the amount of web material N available on the parent reel B.

With any palletizers 24A, 24B members can be associated, to detect whether the consumable (film, banding straps etc.) used to stabilize the packs on the pallet is approaching exhaustion.

The detection systems cited above are capable of predicting the occurrence of a foreseeable or predictable event, which requires a temporary stop. For example, it is possible to predict in advance the need to stop the rewinder due to the exhaustion of a parent reel. Alternatively, it is possible to predict in advance the need to stop a cutting machine when the diameter of the cutting blade 17L approaches the minimum permissible diameter, Alternatively, it is possible to predict in advance the need to stop a wrapping or bundling machine, as the stock of film F1, F2 is approaching exhaustion.

During the normal operation of the production line 1 at least one parent reel B is unwound in one of the unwinders 9A, 9B and the web material N, consisting of a single- or multi-ply of tissue paper, is fed toward the rewinder 13. In the rewinder 13 the web material N is wound to sequentially form logs of tissue paper L, which are accumulated in the accumulator 7.

Normally the machines downstream of the accumulator 3 are oversized with respect to the production capacity of the rewinder 13. In this condition the production line 1 normally operates at full speed in the following conditions:

- the rewinder 13 always runs at its maximum speed
- the accumulator 7 remains almost empty around the minimum level set by the operator
- the cutting machines 17A, 17B and consequently the packing machines 21A, 21B and the bundling machines 23A, 23B run at a speed lower than their maximum speed to adapt to the speed of the rewinder 13, so that the level of the accumulator remains constant.

Consumption of the materials and/or wear of the members of the production line 1 are monitored and detected by the systems listed by way of example above. Each system can generate a warning signal, indicative of the approach of the event that will require the temporary stop of a machine or of a station of the production line 1. The warning signal is generated in advance with respect to the effective event, and therefore it predicts it and allows the control system, and in particular, for example, the control unit 27, to take action on the production line 1 to reduce the negative impact of the subsequent temporary stop on the overall operation of the production line 1. In the present context, "temporary stop request" indicates the signal supplied by one of the detection systems with which the production line 1 is equipped, said signal being indicative of the approach of the event requiring the stop.

In general, the temporary stop request can come from the first section 3, upstream of the accumulator 7, or from the second section 5, downstream of the accumulator 7.

When a temporary stop request is received by the control system of the production line 1, the control system changes the rate of production of one or more machines of the line so as to:

temporarily increase the amount of logs L present in the accumulator 7, when there is a stop request by the first section 3 upstream of the accumulator 7;

or temporarily reduce the amount of logs L present in the accumulator 3 when there is a stop request by the second section 5.

For example, a temporary stop request can come from the second section 5 when one of the packaging machines 21A, 21B, 23A, 23B must be stopped to change the exhausted consumable (reel of film of the packing machines 21A, 21B or of the bundling machines 23A, 23B). When this temporary stop request is received by the control system, this causes a temporary adjustment of the operating speeds of the production line 1 so as to empty the accumulator 3 as much as possible. In this way, a greater amount of space is obtained in the accumulator 3 to temporarily accumulate logs L produced by the rewinder 13 in the interval of time in which the temporary stop of the wrapping machine occurs.

The reduction of the level of filling of the accumulator 3 can be obtained in theory both by reducing the production speed of the rewinder 13 and by increasing the production speed of the machines downstream (in one or in both the branches 19A, 19B). In general, it is not advantageous to slow down the rewinder 13, as this has a negative influence on the general productivity of the production line 1. Moreover, causing a transient in the operation of the rewinder 13 is not advantageous as it can have negative effects on the quality of the end product (logs L and rolls R). Therefore, the accumulator 7 is preferably emptied by accelerating the machines of one, of the other, or of both the branches 19A, 19B.

This is made possible by the fact that the event that causes the temporary stop of one of the two branches was predicted in advance and therefore the machine in question still has a certain level of autonomy and can increase its rate of production.

After the accumulator 7 has been emptied, or after its level of filling has been reduced, the wrapping machine can be stopped and the flow of material that the branch 19A or 19B that stopped is unable to absorb is absorbed by accelerating the machines of the other branch and accumulating logs L in the previously emptied accumulator 7. In this way, the rewinder can continue to operate at its optimal speed, without transients and consequently maintaining the overall productivity of the production line 1.

A similar procedure can be carried out in the case of replacement of a cutting blade 17L or of a grinding wheel 17M.

Ultimately, having emptied the accumulator 7, the possibility of the rewinder 13 not having to slow down or stop is increased due to filling of the accumulator 7 caused by the temporary stop of one of the branches 17A, 17B.

A temporary stop request can come from the first section 3 upstream of the accumulator 7. For example, it may be necessary stop or slow down the rewinder to change the parent reel B. Unless suitable measures are taken, soon after the rewinder 13 has been stopped or slowed down, the logs L of the accumulator 7, which was kept around the minimum filling level, are exhausted and therefore also the cutting machines 17A, 17B and the packaging machines 21A, 21B, 23A, 23B stop.

To prevent this event, the method described herein provides for the following operations. When a temporary stop or temporary slowdown request is generated for replacement of the parent reel B, before stopping or slowing-down the control system acts so as to cause filling of the accumulator 7 or in any case to cause an increase of its level, i.e., an increase of the number of logs L contained in the accumulator 7. To this end, the machines of the second section 5, and in particular the cutting machines 17A, 17B and the packaging machines 21A, 21B, 23A, 23B, can be slowed down, taking them to a speed below the optimal operating speed, i.e., the speed that may have been determined, for example, with the method for identification of the target speed described above.

In some cases, in combination with or alternatively to slowdown of the second section 5, it may be possible to temporarily increase the speed of the rewinder. For example, if before the request to increase the level in the accumulator 7 occurs the rewinder 13 is operating at a speed lower than its maximum speed, it is possible to temporarily increase the speed of the rewinder. This increase of speed and/or slowdown of the rate of production of the section downstream increases the number of logs L accumulated in the accumulator 7.

If it is possible to temporarily increase the speed of the rewinder 13 rather than slow down the speed of the section downstream, a greater average production speed is obtained.

Once the accumulator 7 is full, or at any rate approaching the maximum level of filling, the rewinder 13 can be stopped or slowed down. The logs L accumulated in the full accumulator continue to be fed to the branches 19A, 19B of the second section 5 so as to maintain the cutting machines 17A, 17B and the packaging machines 21A, 21B, 23A, 23B running even during the change of parent reel B upstream of the rewinder 13. This avoids unnecessary stops of the cutting machines 17A, 17B and of the packaging machines 21A, 21B, 23A, 23B. If required, these machines downstream of the accumulator 7 can be slowed down and made to operate at low speed so as to make the stock of logs L in the accumulator 7 last for the time necessary and sufficient to restart the rewinder 13 or, in the case in which it was only slowed down, to return to operation at full speed.

In production lines 1 with two branches 19A, 19B downstream of the accumulator 7 as in the example shown schematically in FIG. 1, according to improved embodiments of the method described it is also possible to predict when the reels of the various packaging machines will require a machine stop and to prevent these machine stops from occurring in the same period of time. This prevents both branches 19A, 19B downstream of the accumulator from stopping simultaneously, which would greatly increase the risk of the rewinder 13 filling the accumulator 7, and consequently having to slow down or even stop.

Similar considerations are valid in the case of the cutting machines 17A, 17B.

In general, when there are several branches in parallel with machines in parallel, likely to request a temporary stop, it is possible to modulate the production speed of the two machines so that the temporary stops are not requested simultaneously or, at any rate, are not overlapping in time.

This is true both in the case of two substantially identical machines in parallel (for example the two cutting machines 17A, 17B, or the packing machines 21A, 21B or the bundling machines 23A, 23B), and in the case of different machines in parallel branches. For example, having systems for predicting the temporary stop request for the three types of machines (cutting machines, packing machines and bundling machines) in the two parallel branches 19A, 19B, the speeds of all the machines of the two branches 19A, 19B can be modulated so as also to avoid overlapping of the stop period of any machine (17A, 21A, 23A) of the branch 19A with any machine (17B, 21B, 23B) of the branch 19B.

Once the machine stop has terminated, the optimal amount of product in the accumulator 7 is replenished.

In the description above reference has been made by way of example to the presence of only one stop or temporary slowdown request, resulting from approach of the need to replace a consumable or a worn member. More in general, as the line 1 contains a number of machines that use consumable and/or that contain elements subject to wear, for which periodic replacement is necessary, multiple stop or temporary slowdown requests can occur. These requests can come from the sections 3, 5 and from different machines of the two sections.

An improved embodiment of the method described can include the steps of:

detecting a plurality of temporary stop or temporary slowdown requests coming from a plurality of machines of the line;

coordinating in time the temporary stop or temporary slowdown requests coming from several machines of the line to carry out at least two temporary stops or temporary slowdowns which at least partially overlap in time.

In some embodiments, the temporary stop or temporary slowdown requests coming from several machines of the section 5 can be coordinated in time, so as to avoid a simultaneous temporary stop or temporary slowdown of the branches 19A, 19B of the section 5.

Carrying out the two (or more) temporary stops or slowdowns "at least partially overlapping in time" means that the two machines that requests the stop or the slowdown are stopped or slowed down in the same interval of time, or so that the stop or slowdown period of one machine at least partially overlaps (i.e., is partially simultaneous to) the stop or slowdown period of the other machine. In this way, the intervals of time during which the line operates in conditions of reduced productivity are reduced.

As the temporary stops or slowdowns are required by predictable events, in advantageous embodiments there is provided a work scheduler, which can be part of the electronic control system of the line 1, and which in FIG. 1 is indicated schematically with 28. The work scheduler 28 can be a software module, run on a processor of the control system 20. The work scheduler 28 receives input data from the various machines, stations or sections of the line 1 and in particular receives the temporary stop or temporary slowdown requests. The work scheduler 28 determines, based on these requests, the temporary stops or slowdowns and their times, if necessary combining two or more the temporary stops or slowdowns or ensuring that the branches 19A, 19B of the section 5 do not stop or slow down simultaneously. In this way, the number of stops or slowdowns carried out by the line is reduced.

For example, if both packaging machines 21A, 23A or 21B, 23B of the same branch 19A, 19B generate a temporary stop request and these stops are theoretically staggered in time, because the stocks of film F1, F2 available have different durations, the work scheduler 28 could impose an advanced replacement of the reel of film that has a greater residual duration, to prevent a double stop.

In other situations, for example, the cutting machine 17B could require a temporary stop for replacement of the blade 17L and one of the packaging machines 21B, 23B could in turn issue a temporary stop request for replacement of the stock of film. The two stops could be requested at different times, for example spaced apart by a few dozen minutes. In this case the work scheduler 28 can impose a delayed temporary stop on the cutting machine 17B, by extending the period of use of the worn blade beyond the optimal replacement time, so as to carry out replacement of the cutting blade 17L in the same period of time in which replacement of the exhausted reel of film F1 or F2 takes place. In some cases the opposite can also occur, i.e., the reel of film is replaced in advance to avoid excessively extending the operation of the cutting machine with worn blade.

If the stop times are of different duration, the overlapping in time will only be partial. At any rate, however, there will be only one temporary stop, instead of two sequential temporary stops, which would require two transients to carry out emptying of the log accumulator 7 L at different times.

The combination of two or more temporary stops or slowdowns can be implemented not only according to when the stop is requested, i.e. based on the amount of time remaining before the temporary stop or slowdown must be implemented, but also based on the duration of the temporary stop or slowdown.

In some embodiments, the temporary stop requests and/or the times established by the control system 20, and in particular by the work scheduler 28 (if present), can be communicated to one or more operators. This can take place, for example, through the use of mobile devices, indicated schematically with 32A, 32B. These devices can, for example, be tablets or smartphones with which one or more operators managing the line are equipped. The information supplied, advantageously with a Wi-Fi system, can include an indication of the operations required and the times allocated for these operations. This allows the operators to act promptly.

FIG. 1 also indicates a user interface 30, through which the recipes for the various types of product to be produced and packaged in the electronic programmable control system 20 can be entered. The recipes in general consist of a plurality of parameters that define the product, for example size of the logs, amount of paper wound, winding density, type of embossing, perforation pitch, number of plies, type of pack (number of rolls per pack, type of packaging material, etc.). In addition to the recipes, data relating to the orders to be processed can be stored. In this way the control system 20 can also take these parameters into account to program the temporary stops or slowdowns. Moreover, for each recipe a maximum speed for the single machines can be provided, and in particular for the rewinder 13. The control system 20 can manage the line 1 based on the maximum speed permitted for each type of product (recipe) to be produced.

While in the preferred embodiments described above predictive action is taken on the level of the log accumulator 7L, in some cases it may be possible to take action on the speed of one or more machines of the line without influencing the level of logs present in the accumulator 7, always in order to reduce the subsequent impact, in terms of overall production of the line 1, of the temporary stop or slowdown determined by a predictable event. For example, if the stop or slowdown of a packaging machine is particularly short, the rate of production of one or more machines of the line can be changed to change the amount of product present in intermediate conveyors between machines arranged in sequence along the line. In fact, these conveyors form small accumulators on whose level of filling it is possible to take action with the same aim of reducing the impact of the subsequent stop or slowdown on the overall productivity of the line.

In the description above specific reference has been made to various possible actions that can require a temporary stop of the line or of a part of it. These stops can be required to replenish a stock of consumable, for example plastic film, paper, etc. Alternatively, they may be required for the replacement of mechanical members subject to wear, such as perforation blades, log cutting blades, etc.

In general terms, the production line can comprise a plurality of functional units, which can require to be stopped for the aforesaid reasons. In the present context, functional unit means in general an element, member or device, or a combination of elements, members or devices of the line, which in general can require to be stopped for maintenance, repairs, replacement of parts, materials or the like. One or more functional units can have members for detecting 4*a*-4*i* (FIG. 1) one or more parameters indicative of the imminent need to stop. In the case of an unwinder, for example 9A, 9B, a member for detecting 4*a*, 4*b* the amount of material present in the parent reel can be provided. A parameter indicative of this amount, which in this case forms the parameter indicative of the need to stop, can be provided. The parameter can be the diameter of the reel being unwound, its weight, or the amount of web material supplied by the previous replacement. Similarly, the amount of plastic film in a wrapping machine, for example 21A, can form the operating parameter detected by a member for detecting 4*h* used to determine the imminent stop request of the wrapping machine. A parameter correlated to the size of the diameter of a cutting blade of a cutting machine, for example 17A, can be detected by a member for detecting 4*q* to determine the imminent stop request of the cutting machine.

While the aforesaid examples refer to quantitative parameters, in some cases there can be provided another physical parameter, such as a vibration, which can be indicative of the wear of a member that requires replacement. The vibration can be determined with a vibration sensor, by means of analysis of a vibration spectrum, by means of an acoustic detection, or in any other suitable manner. A parameter correlated to vibration can be used to predict the need to stop a large number of possible functional units of the production line, which contain mechanical members subject to wear and likely to require replacement.

For example, abnormal vibrations can be detected on the disk-shaped cutting blades of the cutting machines, on the paper perforation blades, or on embossing units.

In some embodiments, sensors capable of detecting the need for a greasing or lubrication operation can also be provided. The need for an operation of this type can be detected, for example, based on an alteration of the vibrations generated by a moving member, for example a rotating member, such as a shaft, a roller, a toothed wheel, etc. In some embodiments, the need for greasing or lubrication operations can be detected based on the occurrence of a mutual contact between members moving in relation to one another.

In all these cases, one or more sensors can be provided to detect one or more significant parameters, useful for detecting the need t a repair, replacement or maintenance operation, in order to program the operation of the line accordingly, according to the criteria described above.

The invention claimed is:

1. A method for managing a production and packaging line of tissue paper products, comprising: at least one log accumulator; upstream of the log accumulator, a first line section comprising at least one unwinder and at least one rewinder; downstream of the log accumulator, a second line section comprising at least one processing station; the method comprising steps of:

unwinding a parent reel by the at least one unwinder and feeding a ply of tissue paper toward the at least one rewinder;

in the at least one rewinder, winding the ply of tissue paper and sequentially forming logs of tissue paper;

accumulating logs produced by the at least one rewinder in the log accumulator;

detecting, by one or more detecting member(s), one or more predetermined parameter(s) indicative of a need for at least one temporary stop or temporary slowdown request by the first line section or by the second line section;

before carrying out the at least one temporary stop or temporary slowdown request, providing temporarily a change of rate of production of at least one machine of the line to minimize impact on the rate of production of a line of a subsequent temporary stop or temporary slowdown, the change of the rate of production also providing a change in level of filling of the log accumulator;

after said providing temporarily the change of rate of production of said at least one machine of the line, carrying out the at least one temporary stop or temporary slowdown request.

2. The method as claimed in claim 1, further comprising steps of:

providing a prediction of a future condition or event that has not yet occurred based upon said one or more parameter(s) detected, and based on said prediction, before the further condition or event occurs, changing operation of a machine or section of the line in order to reduce impact that a future stop will have on overall operation of the line.

3. The method as claimed in claim 1, wherein said providing temporarily the change of rate of production of the at least one machine of the line comprises changing the level of filling of the log accumulator so as to:

(a) temporarily increase an amount of logs present in the log accumulator, if the at least temporary stop or temporary slowdown request comes from the first line section; or (b) temporarily reduce the amount of logs present in the log accumulator if the at least one temporary stop or temporary slowdown request comes from the second line section;

and wherein the at least one temporary stop or temporary slowdown request is carried out after having changed the level of filling of the log accumulator.

4. The method as claimed in claim 1, wherein said providing temporarily the change of rate of production of said at least one machine of the line comprises:

(a) slowing down at least one machine of the second line section, when the at least one temporary stop or temporary slowdown request comes from the first line section, so as to increase an amount of logs accumulated in the log accumulator before the temporary stop or temporary slowdown;

(b) accelerating at least one machine of the second line section, when the at least one temporary stop or temporary slowdown request comes from the second line section, so as to reduce the amount of logs accumulated in the log accumulator before the temporary stop or temporary slowdown.

5. The method as claimed in claim 1, wherein when the at least one temporary stop or temporary slowdown request comes from the first line section, said providing temporarily the change of rate of production of said at least one machine of the line comprises accelerating at least one machine of the first line section so as to increase the amount of logs accumulated in the log accumulator before the temporary stop or temporary slowdown.

6. The method as claimed in claim 1, wherein the at least one temporary stop or temporary slowdown request is caused by a need to replace or replenish a material subject to wear or consumption.

7. The method as claimed in claim 1, further comprising steps of: detecting, by said one or more detecting members, said one or more parameter(s) indicating a need to replace a parent reel in the unwinder;

and generating the at least one temporary stop or temporary slowdown request for the first line section.

8. The method as claimed in claim 1, wherein the second line section comprises at least one cutting machine having at least one blade for cutting logs of tissue paper; and further comprising steps of:

cutting each log coming from the log accumulator into a plurality of rolls by said cutting machine;

detecting by said one or more detecting member(s) a parameter correlated to wear of the blade;

generating a request for a temporary stop or temporary slowdown by the second line section when the wear of the blade is such as to require a replacement of the blade.

9. The method as claimed in claim 1, wherein the second line section comprises at least one packaging machine; and further comprising steps of:

packaging groups of products of tissue paper with a sheet material coming from a stock of sheet material associated with the packaging machine;

detecting by said one or more detecting member(s) a parameter correlated to consumption of the stock of sheet material;

generating a request for temporary stop or temporary slowdown by the second line section when the stock of sheet material require replenishment.

10. The method as claimed in claim 1, further comprising steps of:

in said second line section, dividing a flow of logs coming from the log accumulator into two partial flows;

feeding the two partial flows to two branches arranged in parallel, each branch comprising at least one machine;

modulating an operating speed of the at least one machine in each of the two branches in parallel so as to cause temporary stop or temporary slowdown requests in a manner staggered in time for the two branches in parallel.

11. The method as claimed in claim 1, further comprising steps of:

generating a temporary stop or temporary slowdown request when a need for replacement of the parent reel approaches;

reducing speed of machines of the second line section or increasing speed of machine of the first line section, thereby increasing the number of logs accumulated in the log accumulator;

following increase of the number of logs in the log accumulator, stopping or slowing down the rewinder and replacing the parent reel.

12. The method as claimed in claim 1, further comprising steps of:

detecting, by said one or more detecting member(s), said one or more parameter(s) indicating a need for a plurality of temporary stop or temporary slowdown requests for a plurality of machines of the line;

coordinating with one another in time the temporary stop or temporary slowdown requests coming from several machines of the line to carry out at least two temporary stops or temporary slowdowns at least partially overlapping in time.

13. The method as claimed in claim 1, further comprising steps of:

detecting, by said one or more detecting member(s), said one or more parameter(s) indicating a need for a plurality of temporary stop or temporary slowdown requests for a plurality of machines of the line;

temporarily stopping or temporarily slowing down in a sequence staggered in time two or more branches in parallel with one another.

14. The method as claimed in claim 1, further comprising communicating, from a control unit of the line to one or more mobile electronic devices, information relating to the at least one temporary stop or temporary slowdown request.

15. The method as claimed in claim 14, wherein the information comprises information on time of said at least one temporary stop or temporary slowdown request.

16. The method as claimed in claim 1, further comprising storing a plurality of production parameters defining a recipe of a product to be produced and packaged, and of setting maximum production speeds of at least one machine of the line as a function of said production parameters.

17. A production and packaging line of tissue paper products, comprising: at least one log accumulator; upstream of the log accumulator, a first line section comprising at least one unwinder and at least one rewinder; downstream of the log accumulator, a second line section comprising at least one processing station; a control system constructed and arranged to implement a method as claimed in claim 1.

18. The production and packaging line as claimed in claim 17, further comprising a system for forecasting a need for at least one temporary stop or temporary slowdown associated with at least one machine of the line.

19. A data medium containing a program that executes a method according to claim 1.

* * * * *